United States Patent [19]

Loeb

[11] 4,059,970

[45] Nov. 29, 1977

[54] AUTOMATIC ICEMAKER INCLUDING MEANS FOR MINIMIZING THE SUPERCOOLING EFFECT

[75] Inventor: Leopold Loeb, Louisville, Ky.

[73] Assignee: General Electric Company, Louisville, Ky.

[21] Appl. No.: 732,772

[22] Filed: Oct. 15, 1976

[51] Int. Cl.[2] ..... F25C 1/04; F25C 1/00

[52] U.S. Cl. ..... 62/353; 62/66

[58] Field of Search ..... 62/340, 66, 353, 71

[56] References Cited

U.S. PATENT DOCUMENTS

| | | | |
|---|---|---|---|
| 3,040,545 | 6/1962 | Bollefer | 62/340 |
| 3,254,505 | 6/1966 | De Turk | 62/353 |
| 3,280,588 | 10/1966 | Brindley | 62/340 |
| 3,678,701 | 7/1972 | Powell et al. | 62/353 |
| 3,760,598 | 9/1973 | Jakob et al. | 62/74 |

OTHER PUBLICATIONS

Scientific American, Feb. 1959, How Water Freezes, Bruce Chalmers, pp. 114–122.

Scientific American, Jan. 1961, pp. 120–131, The Growth of Snow Crystals, B. J. Mason.

*Primary Examiner*—William E. Wayner

*Attorney, Agent, or Firm*—Steven C. Schnedler; Francis H. Boos

[57] ABSTRACT

A batch type automatic icemaker adapted for installation in the freezer compartment of a refrigerator includes a means for retaining a piece of ice throughout an entire icemaker operating cycle. The retained ice piece is in communication with at least one of the icemaker mold ice-forming cavities and reliably provides a seed ice crystal to initiate freezing of the water in the ice-forming cavities with a minimum of supercooling.

7 Claims, 8 Drawing Figures

PRIOR ART
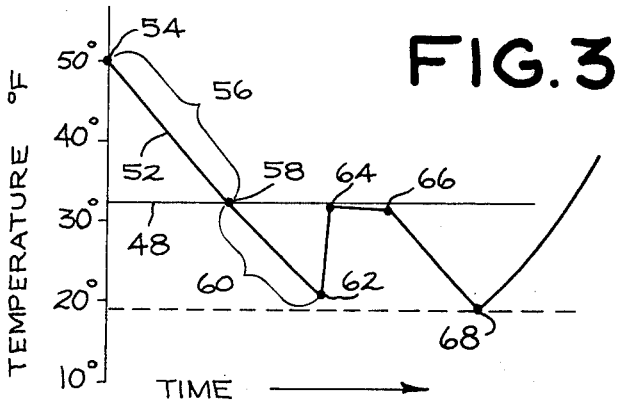
FIG. 3
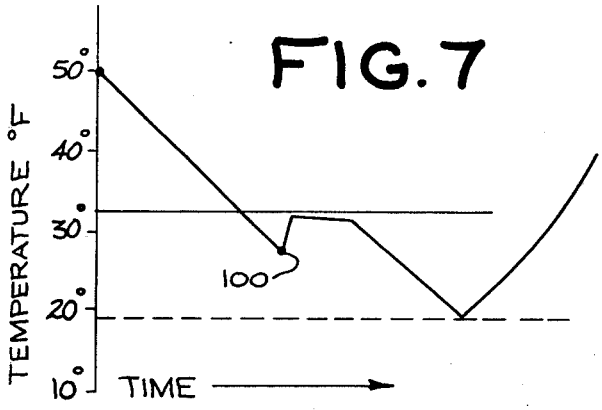
FIG. 7
FIG. 4
PRIOR ART
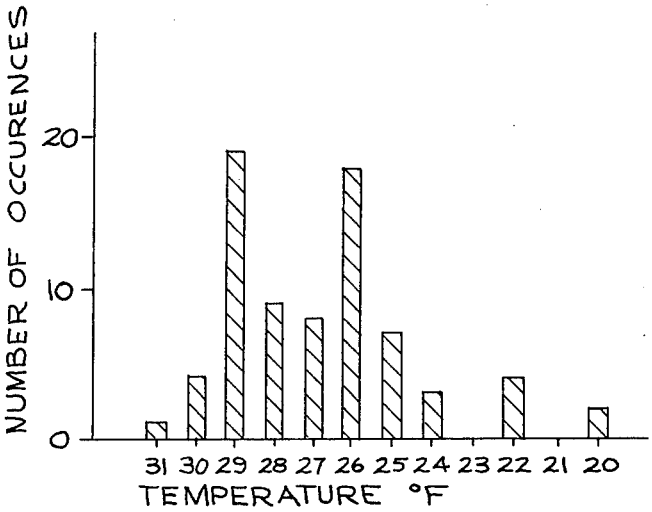
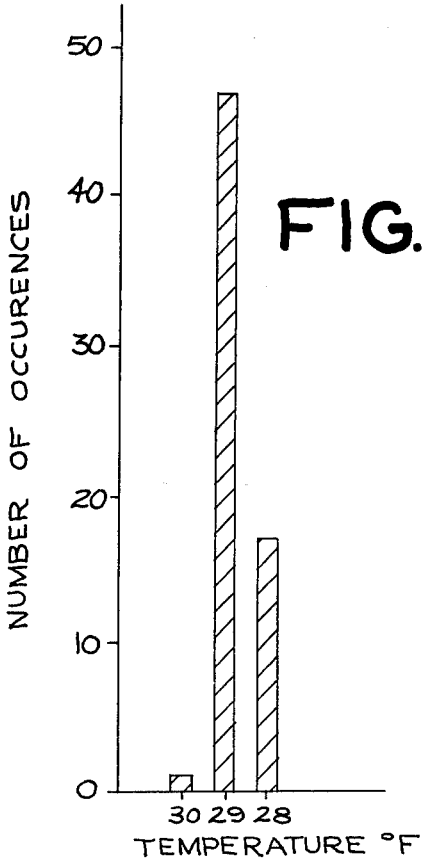
FIG. 8

AUTOMATIC ICEMAKER INCLUDING MEANS FOR MINIMIZING THE SUPERCOOLING EFFECT

BACKGROUND OF THE INVENTION

1. Field of the Invention

The present invention relates generally to batch type automatic icemakers adapted for installation in the freezer compartment of household refrigerators and, more particularly, to such an icemaker including a means to minimize supercooling of water in the mold ice-forming cavities.

2. Description of the Prior Art

A refrigerator automatic icemaker of the type shown and described in U.S. Pat. Nos. 3,163,017 Baker et al and 3,163,018-Shaw includes a mold having at least one ice-forming cavity. To begin the operation cycle, a means is included for filling the ice-forming cavity with a metered quantity of tap water. As the mold and water cools, an ice piece is formed. In order to initiate harvesting of the ice piece, a control means is included. The control means typically includes a temperature-responsive switch element (thermostat) in thermal contact with the mold. The thermostat is set to respond to a temperature well below 32° F. It is assumed that when the mold temperature is below the set temperature, all the water has frozen into ice. A means in the form of an ice-ejecting pad normally positioned in the lower portion of the cavity is included to remove ice pieces from the cavity by raising them up out of the cavity clear of the mold to be swept into a storage bin by a sweep arm.

Although not generally appreciated, 32° F more accurately represents the melting temperature of ice, rather than the initial freezing temperature of water, at least in the absence of a nucleating or "seeding" agent. In most cases, when a quantity of water is cooled for the purpose of freezing it, a temperature well below 32° F is required to initiate freezing. A temperature as low as 25° F is not at all unusual. This phenomenon of liquid water existing below 32° F is known as supercooling and is the rule, rather than the exception. In order for ice crystals to form in water cooled to 32° F or below, initial nucleation must occur. Initial nucleation is usually a random event, occuring at no particular temperature, and may be triggered, for example, by small foreign particles, mold irregularities, or mechanical movement. In the case of a foreign particle as a nucleating agent, the closer the crystal structure of the foreign particle is to the crystal structure of ice, the more effective it is and the less supercooling required before freezing occurs. In any event, the lower the temperature, the easier it is to initiate ice crystal formation. If the temperature is lowered sufficiently, eventually an initial ice nucleate forms spontaneously. It should be noted that, once an initial "seed" ice crystal is formed, the entire quantity of water can freeze with no further difficulty.

In an automatic icemaker of the above-described type, the thermostat which initiates ejection of the ice pieces from the mold cavities is typically set at 16° F with a tolerance of ± 3° F. As mentioned above, when the mold cools down to the set temperature, it is assumed that water in the mold cavities is completely frozen into ice. However, due to the supercooling effect, the mold and the liquid water in the ice-forming cavities can remain liquid even down to the temperature at which it is assumed that ice has been formed, and premature initiation of the ice-harvesting cycle occurs.

This is particularly likely when a particular thermostat sample happens to respond to a temperature at the high end of the tolerance range, that is, 19° F.

When this premature initiation occurs, the ejecting pads in the bottom of the ice-forming cavities rise up through liquid water, of course not removing any ice piece and having no real effect. When the next metered quantity of water enters the icemaker, since the cavities are already full, water simply overflows into the ice storage bin below, resulting in an unusable congealed mass of ice.

This problem of liquid water entering the ice-storage bin is particularly insidious because it occurs so infrequently, perhaps only once in every three or four hundred complete operating cycles in particular icemaker samples which are prone to it. As a result, the true cause is not apparent, especially since the sequence of events is rarely actually observed in an automatic icemaker. In an effort to "repair" the icemaker, parts such as switches and solenoid valves may be replaced, only to have another quantity of water mysteriously discharged into the ice-storage bin months later.

One way to make it statistically unlikely for supercooling to cause any problem is simply to employ a thermostat set to a very low temperature, for example 10° F or lower, since it is unlikely that supercooling would continue to such a low temperature. The disadvantage of this approach lies in a decreased rate of ice production. It simply takes the mold and water or ice contained therein longer to reach such a low temperature, with no attendant advantage if ice has in fact formed.

Another approach might be the use of a particular chemical nucleating or "seeding" agent such as silver iodide or lead iodide. Such substances are known to initiate crystallization, causing liquid water to freeze into ice reliably at a relatively high temperature (still under 32° F). While it might be possible to include such a nucleating substance within an icemaker mold, there are certain drawbacks to such an approach. For example, the substance chosen must have very low solubility in water so as not to be dissipated and, of course, must be nontoxic. Furthermore, no such material is as effective as ice itself in nucleating water close to 32° F. This follows from the fact that these substances can only approach the structure of ice, but cannot be identical.

SUMMARY OF THE INVENTION

Accordingly, it is an object of the invention to minimize supercooling of the mold water in a refrigerator automatic icemaker.

It is another object of the invention to provide apparatus for use in a batch type automatic icemaker to reliably provide a "seed" crystal of ice to promote freezing of the mold water at a temperature just under 32° F.

It is still another object of the invention to minimize supercooling of icemaker mold water in an automatic icemaker and at the same time improve the rate of ice production.

These and other objects are accomplished by the invention in which a batch type automatic icemaker, for example, of the abovedescribed type, includes a means for retaining a piece of ice throughout an entire icemaker operating cycle. The retained ice piece is in communication with one of the ice forming cavities and reliably provides a seed ice crystal to initiate freezing of water in the ice-forming cavities with a minimum of supercooling. In one embodiment, the ice-retaining means is an ice-retaining cavity formed in the mold and sharing a common wall with one of the ice-forming cavities. To provide communication between the ice-retaining and ice-forming cavities, at least one hole is bored through the common wall at a vertical depth below the water fill level of the ice-forming cavity.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

FIG. 3 is a graph plotting mold temperature against time throughout one operating cycle in a typical prior art icemaker not including the present invention;

FIG. 4 is a graph showing an actual distribution of the temperatures at which freezing began over a number of operating cycles in an actual prior art icemaker not including the present invention;

FIG. 7 is a graph similar to that of FIG. 3 but illustrating a typical temperature versus time plot of an icemaker including the present invention; and FIG. 8 is a graph similar to that of FIG. 4 showing a distribution of temperatures at which freezing is initiated in an icemaker including the present invention.

DESCRIPTION OF THE PREFERRED EMBODIMENTS

Figure 1:
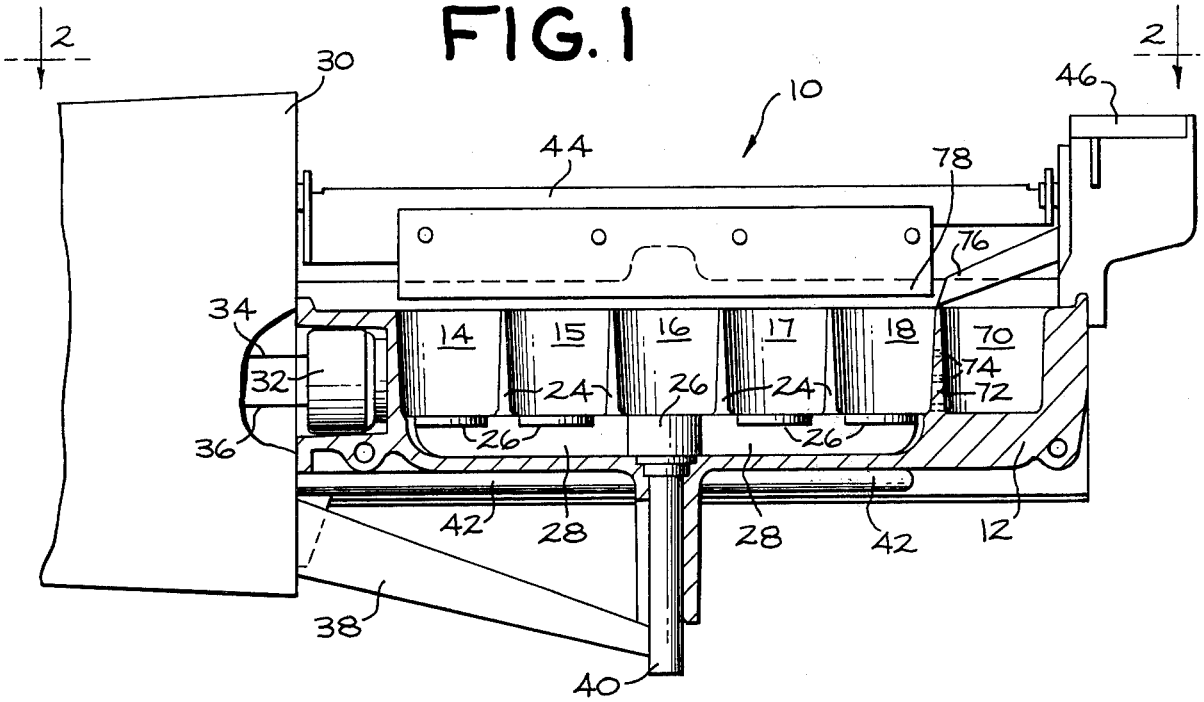
FIG. 1 is a side elevational view of a refrigerator automatic icemaker including one embodiment of the present invention, with a portion of the icemaker cut away in partial section.
Figure 2:
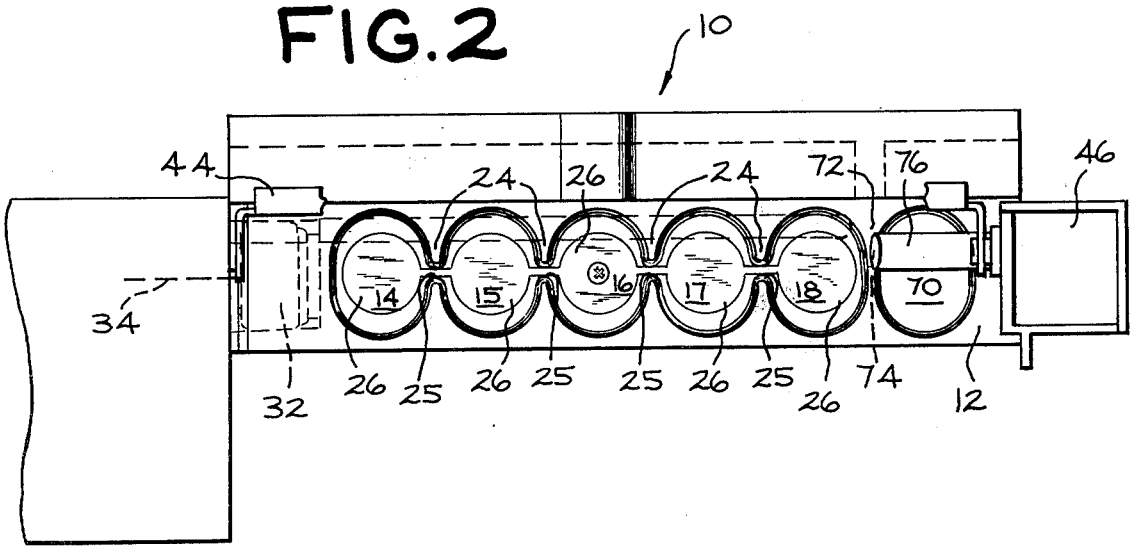
FIG. 2 is a downward view taken along line 2—2 of FIG. 1.

Referring now to the drawings wherein identical reference numerals designate identical or corresponding elements in the various views, in FIGS. 1 and 2 there is generally shown an automatic icemaker 10 including an aluminum mold 12 having generally cylindrical ice-forming cavities 14 through 18 arranged in a straight line and separated from one another by walls 24 which include vertical passage 25 providing means for the flow of water from one cavity to another during the mold-filling operation. A plurality of ejection pads or pistons 26, which to a substantial extent form the bottoms of the cavities 14 through 18, are interconnected by a bar 28 slidably received in the passages in the walls 24.

A mechanism including power and control means for operating the icemaker is generally contained within a housing 30 secured to one end of the mold 12. As part of the control means, a temperature responsive switch element or thermostat 32 is disposed in thermal contact with the mold 12 to initiate harvesting of the ice pieces when they are formed. Conductors 34 and 36 connect the thermostat 32 to circuitry (not shown) for energizing a drive motor (not shown) included within the housing 30. The motor is operatively connected through drive means including a lever 38 and a rod 40 designed to raise the pads 26 and ice pieces carried thereby up out of the ice-forming cavities 14 through 18. In order to warm the mold 12 slightly to free the ice pieces for easy removal from the ice-forming cavities, a heating element 42 thermally contacts the lower portion of the mold 12 and is electrically connected so as to be energized along with the motor. An elongate rake or sweep arm 44, also connected to the mechanism within the housing 30, is provided to sweep the ice pieces which have been raised by the pads 26 to the top of the mold 12 off into an ice storage bin (not shown).

At the other end of the mold 12, a funnel 46 is positioned to receive metered quantities of tap water for filling the ice-forming cavities 14 through 18. An electrically operated solenoid valve (not shown) connected to the icemaker control means controls the water entering the funnel 46.

In the general operation of the icemaker 10 as thus far described, an operating cycle begins with a metered quantity of water entering through the funnel 46 to fill the ice-forming cavities 14 through 18. A representative temperature for tap water entering the icemaker is 50° F. The entire mold 12 warms quickly up to nearly the water temperature. As the mold 12 and the water within the cavities lose heat to the cold air within the freezer, the freezer air temperature being typically 0° F, the mold and water temperature gradually decreases. At some temperature below 32° F, the water in the ice-forming cavities begins to freeze and eventually becomes completely frozen. When the mold temperature reaches approximately 16° F, the thermostat 32 initiates harvesting of the ice pieces. The harvesting operation includes energizing of the heating element 42 to free the ice pieces from the cavities, ejection of the ice pieces by movement of the pads 26 from their lower positions in the bottom of the cavities to a raised position slightly above the upper surface of the mold 12, pivotal movement of the sweep arm 44 across the top of the mold for engaging the ejected ice pieces and sweeping them from the mold, and return of the sweep arm 44 and the pads 26 to their normal positions. This is followed by the introduction of another metered quantity of water through the funnel 46 into the ice-forming cavities to begin the next operating cycle.

A more detailed description of this general type of icemakerand its operation may be had by reference to the above-mentioned U.S. Pat. Nos. 3,163,017 and 3,163,018, which are hereby incorporated by reference.

Referring now to FIG. 3, there is illustrated a plot of mold temperature versus time throughout one operating cycle, beginning with the filling of the ice-forming cavities 14 through 18 and ending with harvesting, in a typical prior art automatic icemaker. While the exact length of one such cycle depends upon factors such as temperature of incoming water, temperature within the freezing compartment, and the amount of air circulation directly over the icemaker, a typical length of time is 40 minutes. Mold temperatures are represented on the vertical axis of the graph, with a horizontal line 48 extending from the 32° F point to indicate the theoretical freezing point of water and a dash horizontal line 50 extending from 19° to indicate the upper end of the tolerance range of a typically employed, temperature responsive switch element such as the thermostat 32 (FIGS. 1 and 2). As a practical matter in mass production, such thermostats are acceptable when they respond to any temperature within a predetermined range of temperatures, for example 16° ± 3° F.

Considering FIG. 3 in detail as it relates to the operating cycle of the icemaker, the solid line 52 is the actual plot of temperature versus time. At the point 54 when tap water initially enters the ice-forming cavities, the water temperature in the ice-forming cavities is approximately 50° F, more or less, depending upon the actual temperature of the incoming water and the mass and initial temperature of the mold 12. The mold and the water gradually cool, as shown by the line segment 56. At the point 58, the mold and water temperature reach and pass through 32° F, but no freezing occurs. A region of supercooling is entered, represented by line segment 60. During this time, water in the ice-forming cavities remains liquid. When the water temperature reaches 20°, indicated by point 62, an initial ice crystal is formed and rapid formation of ice in the cavities results. Due to communication between the cavities through the vertical passages 25, an initial ice crystal forming anywhere within any one of the cavities is effective to cause ice crystallization throughout. The formation of an initial ice crystal is a very random event, and the temperature at which it occurs cannot be predicted with certainty in any given operating cycle. The same icemaker, in successive cycles, may initiate formation of ice crystals at a temperature anywhere within a range beginning at 32° F and extending downward through 20° F.

Once ice crystal formation is initiated, due to the heat of fusion released by the water as it freezes into ice, the water and mold temperature rises rapidly to 32° F. This rapid rise in temperature (from point 62 to point 64) is a sensitive indicator of actual ice formation, and is confirmed by visual observation. The ice pieces form by freezing from the outside in, and until each piece is frozen all the way through to the center, the temperature remains near 32° F. As soon as the water is all completely frozen, beginning at the point 66, there is no more heat of fusion to overcome and the temperature again rapidly falls until it reaches 19° F (point 68), whereupon the thermostat 32 initiates the harvesting cycle.

In FIG. 3, it will be apparent that the point 62 is only 1° degree higher than the 19° line 50. If the supercooling region 60 had continued just a bit farther, the thermostat 32 would have prematurely initiated the harvesting cycle. Since the pads 26 would be moving upward through liquid water, and not against ice pieces, the water would remain in the mold. When the next metered quantity of water entered through the funnel 46, the water, having no other place to go, would spill over into the ice-storage bin (not shown) disposed below the icemaker 10, eventually freezing into a solid lump along with any ice pieces previously stored therein. Sometimes the mechanical movement of the pads 26 up through the supercooled water in the ice-forming cavities is sufficient to trigger ice crystal formation. Even though ice rapidly forms, at this point it is too late. At best, there is only time for a "slush" to form before the pads 26 complete their upward travel.

In FIG. 4, there is shown an actual distribution of temperatures at which freezing began over successive operating cycles in the same icemaker. This chart was compiled by continuously measuring and recording the mold temperature to produce plots such as FIG. 3, and specifically recording the temperature represented by point 62. As shown in FIG. 4, the distribution is quite spread out, indicating that formation of the initial ice crystal to trigger complete freezing is most likely to occur somewhere between 29° F and 25° F, but can be much lower in isolated instances.

Referring now again to FIGS. 1 and 2, in addition to the above-described conventional elements, the icemaker 10 includes a means, contemplated by the present invention, for retaining a piece of ice in communication with at least one of the ice-forming cavities 14 through 18 throughout an entire icemaker operating cycle. This means that at all times there is at least a portion of a retained ice piece in existence, even through successive water filling, freezing, and ice ejecting operations. The retained ice piece is then available to reliably provide a seed ice crystal to initiate freezing of water in the ice-forming cavities with a minimum of supercooling in the succeeding icemaker operating cycle.

The particular ice-retaining means included in the icemaker 10 comprises an ice-retaining cavity 70 which, in the illustrated embodiment, closely resembles the ice-forming cavities 14 through 18, except that it is not provided with an ejection pad in the bottom thereof and the ice piece formed in the ice-retaining cavity 70 is not harvested during normal operation of the icemaker 10. The ice retaining cavity 70 is located adjacent the ice-forming cavity 18, sharing a common wall 72 therewith. The ice-retaining and ice-forming cavities 70 and 18 are in communication by means of circular or slotted holes 74 bored through the common wall 72. In order to assure physical communication between the ice-retaining cavity 70 and the ice-forming cavities 14 through 18, the holes 74 are located at a vertical depth below the water fill level of the ice-forming cavities 14 through 18. Although the ice-retaining cavity 70 is in direct communication with only the ice-forming cavity 18, there is indirect communication with the remaining ice-forming cavities 14 through 17 by means of the vertical passages 25.

As mentioned above, the ice-retaining cavity 70 does not have associated with it ice ejecting means. Preferably, the heating element 42 does not extend all the way under the ice-retaining cavity 70, although since the heating operation is intended to only effect a surface melting, the heating element 42 could extend all the way to the end of the mold 12 if desired. In order to further reduce thermal stress tending to melt the ice piece in the ice-retaining cavity 70, an extended outlet chute 76 is associated with the funnel 46 and is so designed to direct incoming tap water directly into the ice-forming cavity 18, bypassing the ice-retaining cavity 70. To avoid mechanical interference between the extended chute 76 and the sweep arm 44, the working face 78 thereof is suitably shortened.

Although the ice-retaining cavity 70 is illustrated as being full size, that is, the same size as the ice-forming cavities 14 through 18, this is an optional design consideration. It is only necessary that the ice-retaining cavity 70 be sufficiently large so that the ice piece retained therein is large enough to withstand the heating cycle at the start of ejection and to withstand the heating of the mold 12 caused by incoming water at the beginning of the operating cycle. Of the two, the warming effect of incoming tap water is the most important.

In the operation of the icemaker 10 including an embodiment of the present invention, an ice piece remains in the ice-retaining cavity throughout each entire icemaker operating cycle, and in fact remains during the entire operating life of the icemaker 10. During the ice-ejection portion of the operating cycle, as the pads 26 rise, the thin tubes of ice formed in the communication holes 74 are easily sheared off. During the cooling and freezing portion of the succeeding operating cycle, the ice piece retained in the cavity 70 is avaiable to reliably seed and initiate ice crystal formation in the ice-forming cavities 14 through18 at a temperature only slightly below 32° F.

Figure 5:
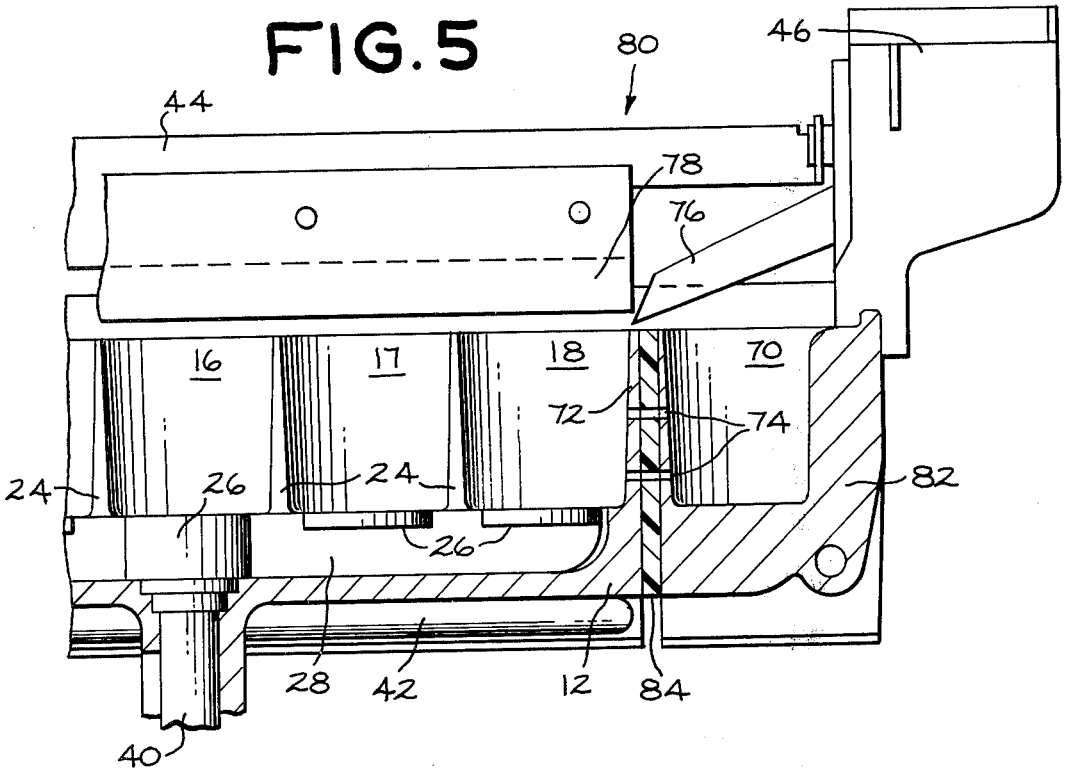
FIG. 5 is a portion of an automatic icemaker including another embodiment of the present invention wherein a common wall between the ice-retaining and ice-forming cavities comprises thermal insulation material.

Referring now to FIG. 5, an icemaker 80 includes a modification of the icemaker 10 (FIGS. 1 and 2) intended to reduce the melting of the retained ice piece. This is especially needed when the incoming water is at a particularly high temperature. In the icemaker 80, the mold portion 82 containing the ice-retaining cavity 70 is thermally isolated from the bulk of the mold 12 by forming at least a portion of the common wall 72 of a suitable non-toxic thermal insulation material 84. Two examples of suitable plastic thermal insulation materials are high density polyethylene and polyvinylchloride.

The general operation of the embodiment of the invention included in the icemaker 80 is otherwise the same as the operation of the embodiment of the invention included in the icemaker 10 (FIGS. 1 and 2) and need not be repeated. A specific difference, however, is that in the embodiment of FIG. 5, there is much less of a tendency for the retained ice piece to melt during the ice ejecting and, particularly, after the water fill portions of the operating cycle. Although not so illustrated, the ice-retaining cavity 70 could be made substantially smaller, taking advantage of this decreased tendency to melt.

Figure 6:
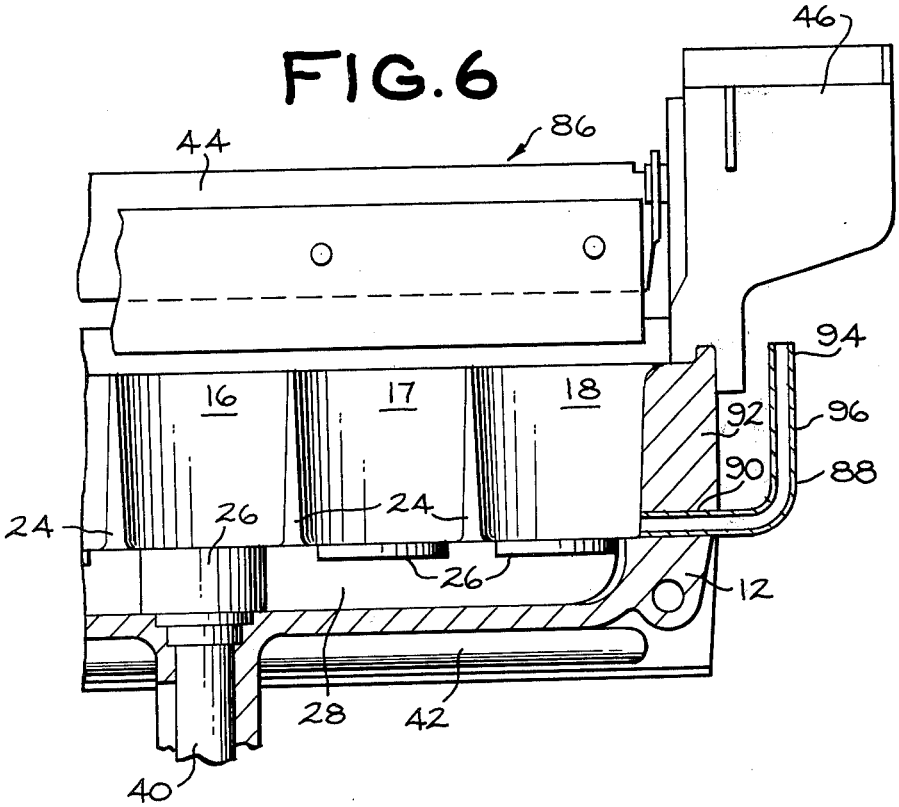
FIG. 6 is a portion of an automatic icemaker including yet another embodiment of the present invention.

Referring now to FIG. 6, there is illustrated an icemaker 86 including another embodiment of the present invention. While the present invention in its broader aspects comprehends the embodiment of FIG. 6, the specific embodiment illustrated in FIG. 6 is not the subject matter of the present invention, but rather is the sole invention of Frank A. Schumacher.

This embodiment also includes a means for retaining a piece of ice in communication with the ice-forming cavities 14 through 18 throughout an entire ice-making cycle. In this embodiment, all of the cavities formed within the mold 12 itself are ice-forming cavities and the retained ice piece is retained externally of the mold 12. In the icemaker 86, a generally L-shaped plastic stand pipe 88 is installed in a suitable bore 90 through an external wall 92 of the mold 12 in communication with the ice-forming cavity 18 near the lower end thereof. To ensure that water does not spill out of the stand pipe 88, the upper end 94 is at least as high as the water fill level in the ice-forming cavities 14 through 18.

The stand pipe 88 is formed of plastic, rather than metal, to take advantage of the thermal insulation properties of plastic. This provides significant thermal isolation between the stand pipe 88, at least the vertical portion 96 thereof, and the mold 12. Additionally, since the vertical portion 96 is spaced from the mold 12, it is exposed to and influenced by cold air within the freezing compartment of the refrigerator within which the icemaker 86 is installed and this aids in retarding melting of the retained ice piece. The diameter of the stand pipe 88 is large enough so that a sufficiently large ice piece is formed and retained therein to withstand the heating it is subjected to, particularly during the water fill portion of the operating cycle when liquid water tends to enter the lower part of the stand pipe 88. A particular inside diameter for the stand pipe 88 found experimentally to be suitable is two millimeters.

The operation of the embodiment illustrated in FIG. 6 is substantially the same as the operation of the embodiments illustrated in FIGS. 1, 2 and 5, so a further description thereof will not be repeated.

Referring now to FIG. 7, there is illustrated a plot comparable to FIG. 3, but showing the benefit derived from the use of the present invention. In FIG. 7, the point 100 at which ice forming is initiated is consistently about 28° or 29° F, well above the 19° F set point of the thermostat 32. This provides a considerable margin of safety insofar as minimizing the chance of supercooling. Furthermore, if desired, the set point of the thermostat 32 can be raised above 19° F for increased ice production rates. Increased ice production can result because time is not wasted chilling ice pieces further once they have already become frozen. However, there is an upper limit above which the temperature set point cannot be raised without the risk of ejecting only partially frozen ice pieces. Since the ice pieces freeze from the outside in, and the ice itself is somewhat of a thermal insulator, the outer portions of ice pieces as they are forming may be lower in temperature than the still-unfrozen water in the center. Keeping the set point sufficiently low, for example below 25° F, insures that sufficient time is allowed for thorough freezing of the ice pieces.

Referring now to FIG. 8, there is graphically illustrated a distribution similar to that of FIG. 4, showing the temperatures at which ice formation began during each of an acutal series of consecutive icemaker operating cycles. As shown, when the present invention is employed, freezing consistently occurs at or above 28° F.

It will be apparent, therefore, that the present invention provides apparatus for minimizing the supercooling effect in a batch type automatic icemaker and which permits upward adjustment of the thermostat set point to increase the rate of ice production, without the risk of excessive supercooling. Although the invention has for convenience been illustrated and described with reference to a particular type of batch type automatic icemaker, it will be apparent that it could be applied equally well to other types of batch type icemakers.

While specific embodiments of the invention have been illustrated and described herein, it is realized that modifications and changes will occur to those skilled in the art. It is therefore to be understood that the appended claims are intended to cover all such modifications and the changes as fall within the true spirit and scope of the invention.

What is claimed is:

1. In a batch type automatic icemaker adapted for installation in the freezer compartment of a refrigerator and including a mold having an ice-forming cavity, means for filling said ice-forming cavity with water, control means, and means responsive to the control means for removing ice pieces from said ice-forming cavity, the combination with said ice-forming cavity of:

means for retaining a piece of ice in communication with said ice-forming cavity throughout each entire icemaker operating cycle;

whereby the retained ice piece reliably provides a seed ice crystal during the next operating cycle, to initiate freezing of water in said ice-forming cavity with a minimum of supercooling.

2. An icemaker according to claim 1, wherein said means for retaining a piece of ice throughout an entire icemaker operating cycle comprises an ice-retaining cavity in communication with the ice-forming cavity.

3. An icemaker according to claim 2, wherein said ice-retaining cavity is formed in the mold, sharing a common wall with the ice-forming cavity and communicating with the ice-forming cavity through a hole bored through the common wall at a vertical depth below the water fill level of the ice-forming cavity.

4. An icemaker according to claim 3, wherein said common wall comprises thermal insulation material.

5. In a batch type automatic icemaker adapted for installation in the freezer compartment of a refrigerator and including a mold having an ice-forming cavity, means for filling the ice-forming cavity with water, and means responsive to the control means for removing ice pieces from the ice-forming cavity, the improvement comprising:

an ice-retaining cavity in communication with the ice-forming cavity, said ice-retaining cavity being constructed to retain an ice piece through the ice-ejection portion of one icemaker operating cycle and through the water-fill portion of the succeeding icemaker operating cycle, whereby the retained ice piece reliably provides a seed ice crystal to initiate freezing of water in the ice-forming cavity during the succeeding operating cycle with a minimum of supercooling.

6. An icemaker according to claim 5, wherein said ice-retaining cavity is formed in the mold, sharing a common wall with the ice-forming cavity and communicating with the ice-forming cavity through a hole bored through the common wall at a vertical depth below the water fill level of the ice-forming cavity.

7. An icemaker according to claim 6, wherein said common wall comprises thermal insulation material.

* * * * *